US008004386B2

(12) United States Patent
Chen et al.

(10) Patent No.: US 8,004,386 B2
(45) Date of Patent: Aug. 23, 2011

(54) THIN FILM RESISTOR STRUCTURE AND FABRICATION METHOD THEREOF

(75) Inventors: Yu-Chung Chen, Hsinchu County (TW); Hung-Kun Lee, Taipei County (TW); Jung-Chou Oung, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 736 days.

(21) Appl. No.: 12/135,918

(22) Filed: Jun. 9, 2008

(65) Prior Publication Data

US 2009/0256670 A1 Oct. 15, 2009

(30) Foreign Application Priority Data

Apr. 10, 2008 (TW) ..... 97113003 A

(51) Int. Cl.
*H01C 1/012* (2006.01)

(52) U.S. Cl. ..... 338/307; 338/333; 338/326; 29/620

(58) Field of Classification Search ..... 338/307–309, 338/333, 322, 226; 29/620
See application file for complete search history.

(56) References Cited

U.S. PATENT DOCUMENTS

| | | | | |
|---|---|---|---|---|
| 4,695,853 | A * | 9/1987 | Hackleman et al. | 347/62 |
| 4,888,089 | A * | 12/1989 | Marstiller et al. | 216/16 |
| 5,278,012 | A * | 1/1994 | Yamanaka et al. | 430/30 |
| 5,652,540 | A * | 7/1997 | Eilley | 327/565 |
| 5,661,450 | A * | 8/1997 | Davidson | 338/320 |
| 6,314,216 | B1 * | 11/2001 | Schulte et al. | 385/17 |

FOREIGN PATENT DOCUMENTS

| | | |
|---|---|---|
| JP | 11-340595 | 12/1999 |
| JP | 2004-040073 | 2/2004 |
| JP | 2005-123481 | 5/2005 |
| JP | 2008-288467 | 11/2008 |

OTHER PUBLICATIONS

Japan Patent Office, Notice of Allowance, Patent Application Serial No. 2008-307478, Mar. 8, 2011, Japan.

* cited by examiner

*Primary Examiner* — Kyung Lee

(57) ABSTRACT

A thin film resistor structure is disclosed. The resistor structure comprises a resistor film comprising a copper oxide layer and a plurality of metal islands thereon. The copper oxide layer has a top surface comprising a plurality of adjacent nodule-shaped recess regions, in which vacancies are formed between the nodule-shaped recess regions and are arranged in reticulate distribution. The plurality of metal islands is respectively distributed in the vacancies between the nodule-shaped recess regions. A method for fabricating the thin film resistor structure is also disclosed.

19 Claims, 6 Drawing Sheets

THIN FILM RESISTOR STRUCTURE AND FABRICATION METHOD THEREOF

CROSS REFERENCE TO RELATED APPLICATIONS

This Application claims priority of Taiwan Patent Application No. 097113003, filed on Apr. 10, 2008, the entirety of which is incorporated by reference herein.

BACKGROUND OF THE INVENTION

1. Field of the Invention

The invention relates to a passive component and more particularly to a thin film resistor structure and a method for fabricating the thin film resistor structure.

2. Description of the Related Art

Some essential elements for printed circuit boards (PCB), are copper foil wiring and passive components such as resistors. For conventional PCB fabrication, copper foil wiring is formed by forming a copper clad laminate (CCL), followed by a development, an etching, and a stripping process (hereinafter referring to as a DES process). Thereafter, discrete passive components may be mounted on the PCB by a surface mount technology (SMT) process. However, with more and more passive components being required on a PCB due to increased functions and miniaturization of electronic products, the area for devices on a PCB are becoming increasingly limited. In order to address the limitation, a major technological approach used, is to reduce the size of the passive components. However, it is extremely difficult to reduce the size of passive components to be smaller than the physiologic limits of vision in physiographic observation, like the 0201-type resistor, with the aforementioned processes.

In order to address the difficulty, planar embedded/buried resistors were developed in the 80's, to reduce the size of passive components on a PCB. Currently, the most popular embedded resistors are classified into thick film-type resistors and thin film-type resistors, in which thick film-type resistors have a thickness of more than 10 μm and thin film-type resistors have a thickness of less than 2 μm. Moreover, thick film resistors can be further classified into lower temperature co-fired ceramic (LTCC)-type resistors and polymer thick film (PTF)-type resistors. Thick film resistors have advantages of broad resistance range and low fabrication cost. However, thick film resistors have poor resistance tolerance. Specifically, for LTCC-type resistors, drawbacks include high processing temperatures and poor polymer substrate compatibility and for PTF-type resistors, drawbacks include a high temperature coefficient of resistance (TCR) and poor thermal stability. As such, applications for thick film resistors are limited. Conversely, thin film resistors have advantages of good polymer substrate compatibility, thermal stability and resistance tolerance when compared to thick film resistors, by employing a metal foil substrate. However, due to the constraint of low electric resistivity, applications for alloy thin film resistors are also limited. The commercially reachable resistance range of the alloy thin film resistors are too much low (i.e. ≦250Ω/) to meet the predominant resistance range requirements of most devices (i.e. 10000Ω/).

Accordingly, thin film resistors with high resistivity are needed to advance application of embedded resistors along with technological trends. Additionally, low TCR (e.g. <200 ppm/° C.) characteristics must not be sacrificed while achieving high resistivity, to prevent reduction of thermal stability.

BRIEF SUMMARY OF THE INVENTION

A detailed description is given in the following embodiments with reference to the accompanying drawings. A thin film resistor structure and a fabrication method thereof are provided. An embodiment of a thin film resistor structure comprises a resistor film comprising a copper oxide layer and a plurality of metal islands thereon. The copper oxide layer has a top surface comprising a plurality of adjacent nodule-shaped recess regions, in which vacancies are formed between the nodule-shaped recess regions and are arranged in reticulate distribution. The plurality of metal islands is respectively distributed in the vacancies between the nodule-shaped recess regions.

An embodiment of a method for fabricating a thin film resistor structure comprises providing a copper foil substrate having a top surface comprising a plurality of adjacent nodule-shaped protrusions, wherein vacancies are formed between the nodule-shaped protrusions and are arranged in reticulate distribution. A colloidal solution containing metal or a solution containing a precursor (hereinafter referring to as a solution containing metal) is coated on the top surface of the copper foil substrate and fills the vacancies between the nodule-shaped protrusions. A heat treatment process is performed on the copper foil substrate to form a copper oxide layer on the surfaces of the nodule-shaped protrusions and simultaneously form a plurality of metal islands, transformed from the solution containing metal, in the vacancies between the nodule-shaped protrusions. The heat treated copper foil substrate is then placed against an insulating substrate and laminated, such that the copper oxide layer is bonded with the insulating substrate. A resistor region and two electrode regions are defined on the copper foil substrate. The copper oxide layer and the plurality of metal islands are partially exposed by removing the copper foil substrate and the nodule-shaped protrusions corresponding to the resistor region using the DES processes, such that the exposed copper oxide layer has a top surface comprising a plurality of nodule-shaped recess regions. An insulating layer (for an embedded resistor application) or solder mask layer (for a surface resistor application) covers the exposed copper oxide layer and fills the plurality of nodule-shaped recess regions.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 1A:
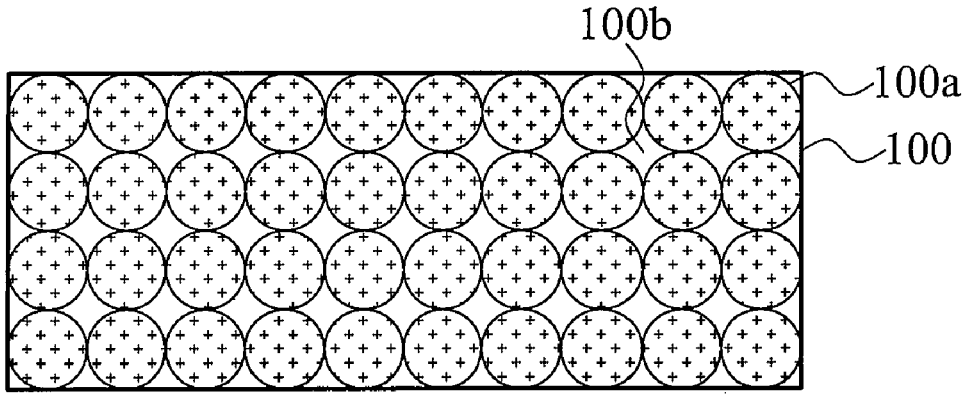
FIGS. 1A to 1F are plan views of an exemplary embodiment of a method for fabricating a thin film resistor structure according to the invention.

The following description is of the best-contemplated mode of carrying out the invention. This description is provided for the purpose of illustrating the general principles of the invention and should not be taken in a limiting sense. The scope of the invention is best determined by reference to the appended claims.

The invention relates a thin film resistor structure and fabrication method thereof, which is capable of increasing sheet resistance while maintaining low TCR. Such a thin film resistor structure can be applied as an embedded resistor in a PCB or other semiconductor device. Referring to FIGS. 1F and 2F, in which FIG. 1F is a plan view of an exemplary embodiment of a thin film resistor structure according to the invention and FIG. 2F is a cross sections corresponding to FIG. 1F. The thin film resistor structure may comprise a resistor film 107, an insulating substrate 108, an insulating layer 114 and two electrodes 110. In the embodiment, the resistor film 107 comprises a copper oxide layer 104 and a plurality of metal islands 106. The copper oxide layer 104 has a property of a P-type semiconductor. That is, the copper oxide layer 104 has a property of TCR contrary to that of the metal. In another embodiment, the copper oxide layer 104 may comprise of other metal oxides therein, such as nickel oxide. The copper oxide layer 104 has a top surface comprising a plurality of adjacent nodule-shaped recess regions 112. Vacancies are formed between the nodule-shaped recess regions 112 and arranged in reticulate distribution. The plurality of metal islands 106 is formed on the copper oxide layer and is respectively distributed in the vacancies between the nodule-shaped recess regions 112 to form metal islands 106 with dispersed phase. The plurality of metal islands 106 may comprise a noble metal with anti-oxidize ability, such as platinum (Pt), palladium (Pd), Ruthenium (Ru), Rhodium (Rh), Iridium (Ir), Aurum (Au), Argent (Ag), or alloy thereof. In a preferred embodiment, the plurality of metal islands 106 may comprise palladium, and copper content in the resistor film of more than 15.0 $\mu g/cm^2$ and palladium content in the resistor film of more than 7.0 $\mu g/cm^2$. As a result, the sheet resistance range of the resistor film 107 can be greatly increased (i.e. >10000Ω/) while the TCR can still be maintained at less than 200 ppm/° C.

The insulating substrate 108 is disposed under the resistor film 107, serving as a carrier for the resistor film 107. The insulating substrate 108 may comprise epoxy for hard board or polyimide (PI) for soft board.

The insulating layer 114 partially covers the resistor film 107 to fill the nodule-shaped recess regions 112 of the copper oxide layer 104 and expose two ends of the copper oxide layer 104. The insulating layer 114 may comprise insulating materials for embedded resistor application or solder mask materials for surface resistor application.

The electrodes 110 respectively cover both exposed ends of the resistor film 107 and are electrically connected thereto.

Figure 2A:
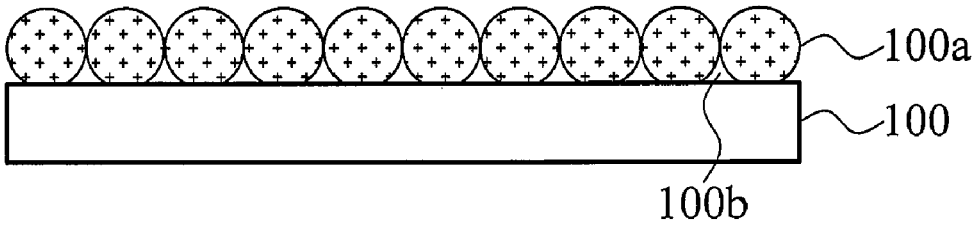
FIGS. 2A to 2F are cross sections corresponding to FIGS. 1A to 1F, respectively.
Figure 1B:
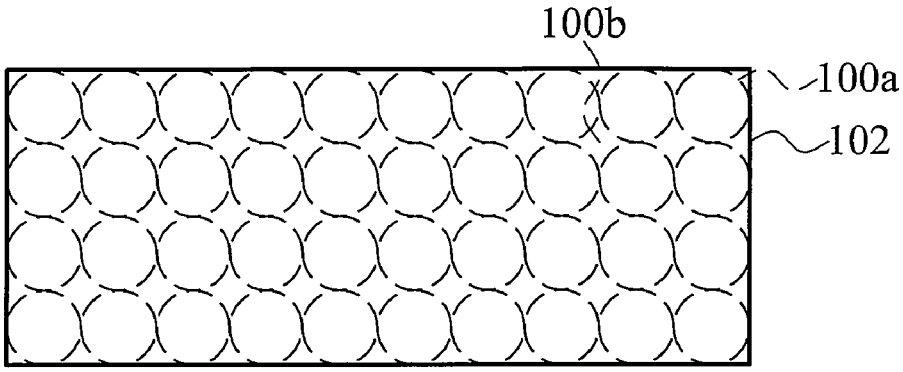
Figure 2B:
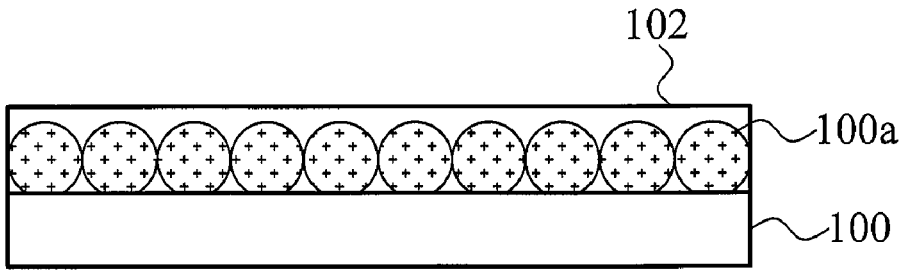
Figure 1C:
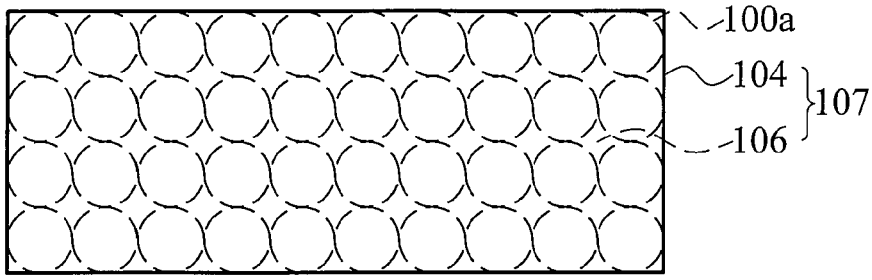
Figure 2C:
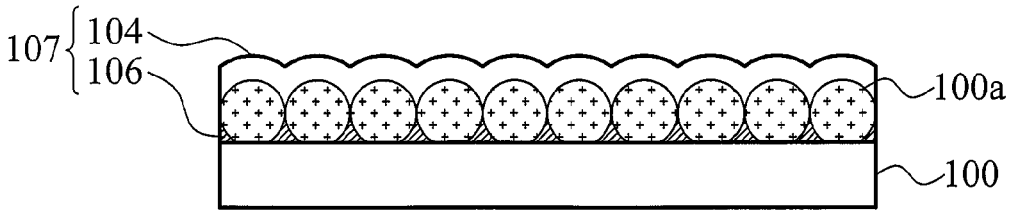
Figure 1D:
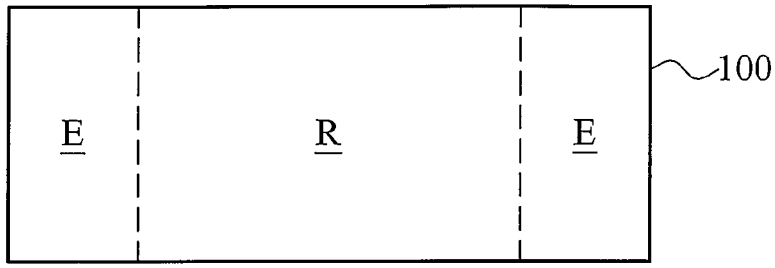
Figure 2D:
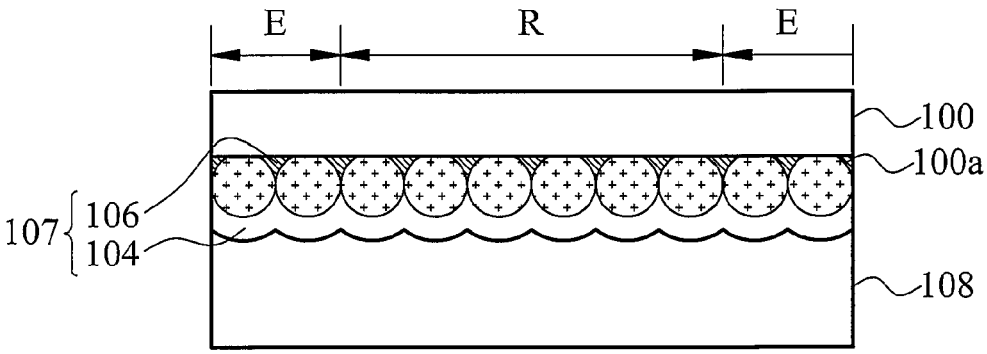
Figure 1E:
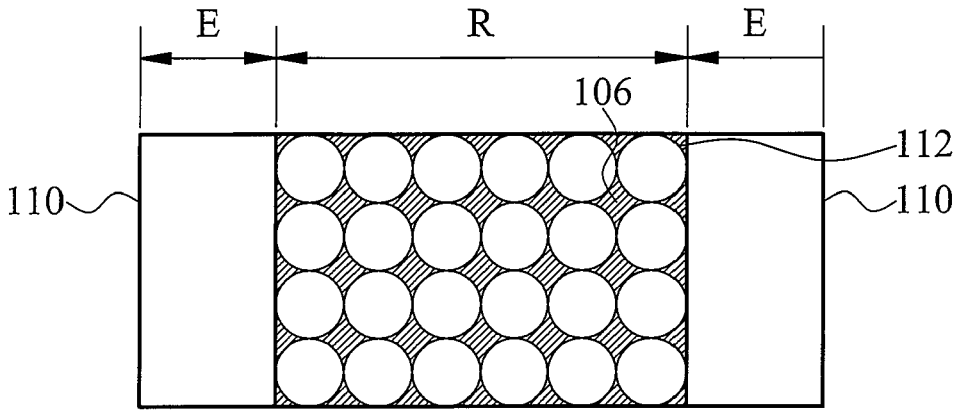
Figure 2E:
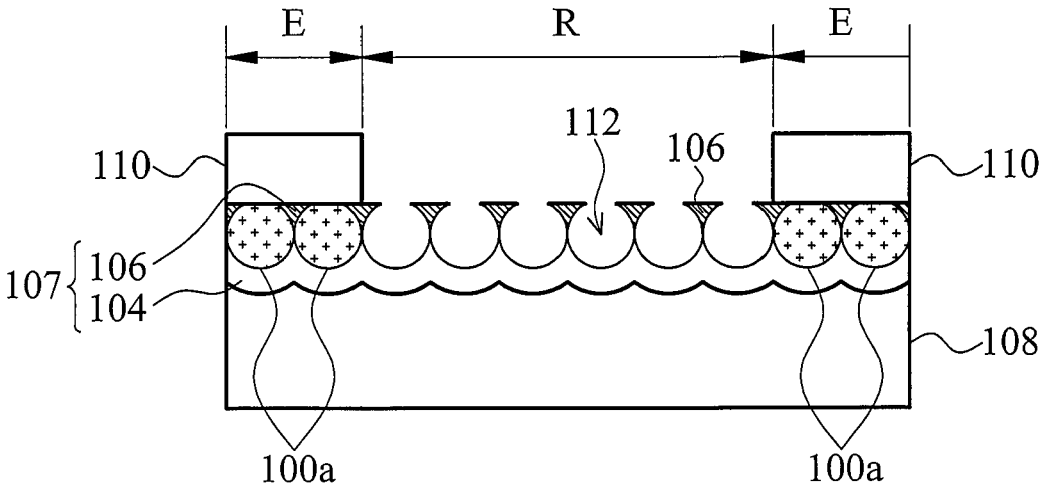
Figure 1F:
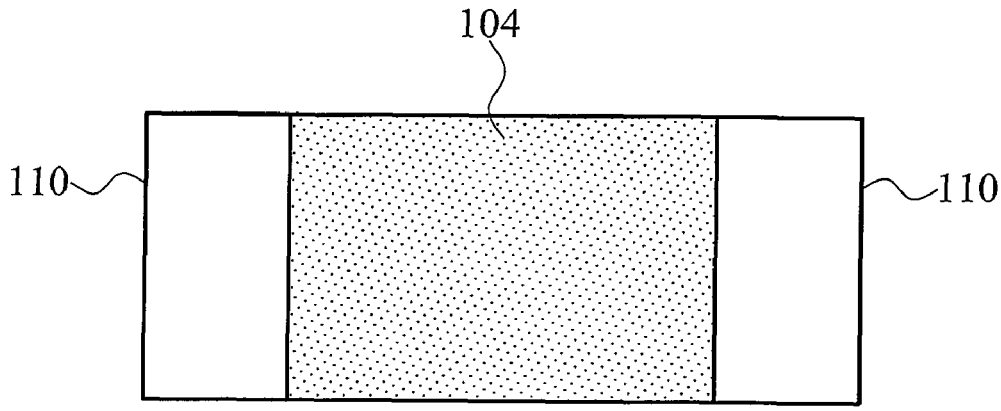
Figure 2F:
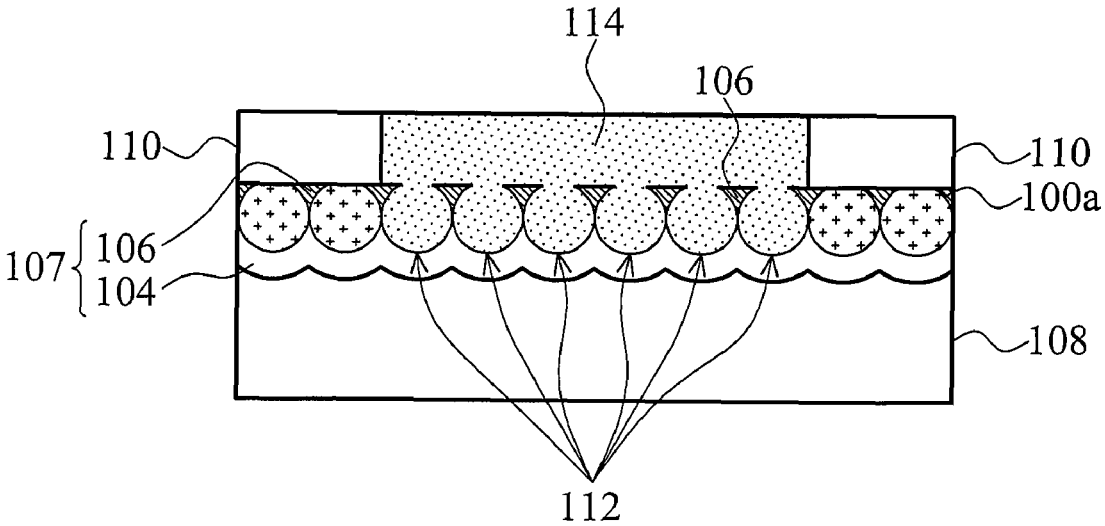

Referring to FIGS. 1A to 1F and 2A to 2F, in which FIGS. 1A to 1F are plan views of an exemplary embodiment of a method for fabricating a thin film resistor structure according to the invention and FIGS. 2A to 2F are cross sections corresponding to FIGS. 1A to 1F, respectively. As shown in FIGS. 1A and 2A, a copper foil substrate 100 having a top surface comprising a plurality of adjacent nodule-shaped protrusions 100*a* is provided. Vacancies 100*b* are formed between the nodule-shaped protrusions 100*a* and arranged in reticulate distribution. The plurality of nodule-shaped protrusions 100*a* can be formed by performing a roughening process, such as nodulization, on the top surface of the copper foil substrate 100.

Referring to FIGS. 1B and 2B, a solution containing metal 102 is coated on the top surface of the copper foil substrate 100 and entirely fills the vacancies 100*b* formed between the nodule-shaped protrusions 100*a*. The metal contained in the solution 102 may comprise platinum (Pt), palladium (Pd), Ruthenium (Ru), Rhodium (Rh), Iridium (Ir), Aurum (Au), Argent (Ag), or alloy thereof. In one embodiment, the solution containing metal 102 is a solution comprising a mixture of $Pd(OAc)_2$ and $CHCl_3$, in which the solution 102 comprising the mixture of $Pd(OAc)_2$ and $CHCl_3$ has a concentration of about 0.1 g/10 cc to 0.4 g/10 cc. In another embodiment, the solution containing metal 102 is a colloidal solution containing metal particles, such as a colloidal solution containing silver particles. The solution containing metal 102 may be coated on the on the top surface of the copper foil substrate 100 by a dip coating, spin coating, spray coating, or slot die coating process. For example, a solution comprising a mixture of $Pd(OAc)_2$ and $CHCl_3$ is coated on the top surface of the copper foil substrate 100 and entirely fills the vacancies 100*b* by performing spin coating with a rotation rate of about 2000 rpm for about 20 seconds. Additionally, note that such the spin coating process can be performed twice or more than twice based on design demands.

Referring to FIGS. 1C and 2C, a heat treatment process is performed on the copper foil substrate 100 coated by the solution containing metal 102 in a non-vacuum environment, thereby forming a copper oxide layer 104 on the surfaces of the nodule-shaped protrusions 100*a* and simultaneously forming a plurality of metal islands 106, transformed from the solution containing metal 102, in the vacancies 100*b* between the nodule-shaped protrusions 100*a*. For example, the heat treatment process is performed on the copper foil substrate 100 at a temperature lower than 300° C., for example, 200° C. Moreover, the heat treatment process is performed for about 15 to 30 minutes. After the heat treatment process is performed, the surfaces of the nodule-shaped protrusions 100*a* are oxidized to form the copper oxide layer 104 thereon. In the embodiment, nickel can be incorporated into the copper foil substrate 100 during nodulization, such that the copper oxide layer 104 comprises nickel oxide therein. On the other hand, the metal contained in the solution 102 (e.g. a solution comprising a mixture of $Pd(OAc)_2$ and $CHCl_3$) can be simultaneously reduced by thermal decomposition, to form a plurality of metal islands 106 (e.g. palladium islands) with dispersed phase. As a result, a resistor film 107 is completed. Table 1 shows the measurements of the sheet resistance ($\rho_s$, Ω/) and TCR (ppm/° C.) of the resistor film 107 with different copper contents ($\mu g/cm^2$) and palladium contents ($\mu g/cm^2$):

TABLE 1

| Sample No. | $\rho_s$ (Ω/) | TCR (ppm/° C.) | palladium ($\mu g/cm^2$) | copper ($\mu g/cm^2$) |
|---|---|---|---|---|
| 1 | 134.1 | 107.4 | 33.9 | 42.1 |
| 2 | 672.2 | 63.4 | 32.8 | 26.1 |
| 3 | 7963 | −129 | 8.4 | 16.8 |
| 4 | 10235 | −146 | 7.7 | 15.4 |
| 5 | 63996 | −750 | 8.3 | 12.7 |
| 6 | 258086 | −1454 | 5.9 | 9.5 |

As shown in Table 1, the composite resistors had a high sheet resistance (e.g. >10000Ω/) and the sheet resistance was substantially gradually increased as the content of copper and palladium was gradually reduced. Meanwhile, note that TCR rapidly increased (e.g. >200 ppm/° C.) with copper content of less than 15.0 $\mu g/cm^2$ and palladium content of less than 7.0 $\mu g/cm^2$. Thus, the thermal stability of the resistor was reduced. Note that preferred embodiments were resistor film samples having a copper content of more than 15.0 $\mu g/cm^2$ and a palladium content of more than 7.0 $\mu g/cm^2$. Specifically, resistor film 107 formed by such conditions had a high sheet resistance (e.g. >10000Ω/) and a low TCR (e.g. <200 ppm/° C.).

Referring to FIGS. 1D and 2D, the structure shown in FIGS. 1C and 2C is placed against an insulating substrate 108, such as an epoxy-based or PI-based substrate, such that the copper oxide layer 104 is boned with the insulating substrate 108. Thereafter, a resistor region R and two electrode regions E are defined on the copper foil substrate 100.

Referring to FIGS. 1E and 2E, the copper foil substrate 100 and the plurality of nodule-shaped protrusions 100*a* corresponding to the resistor region R are removed by a conventional DES process, to expose the copper oxide layer 104 and the metal islands 106 corresponding to the resistor region R. Nodule-shaped recess regions 112 are correspondingly formed on the exposed surface of the copper oxide layer 104 due to the removal of the nodule-shaped protrusions 100*a*. The left copper foil substrate 110 corresponding to the two electrode regions E serve as two electrodes of the resistor film 107.

Referring to FIGS. 1F and 2F, the exposed copper oxide layer 104 and the metal islands 106 corresponding to the resistor region R are covered by an insulating layer 114, such as solder mask, epoxy, or PI, and the plurality of nodule-shaped recess regions 112 is filled with the insulating layer 114. As a result, the fabrication of thin film resistor is completed. The fabrication steps shown in FIGS. 1D to 1F and 2D to 2F can be integrated into conventional PCB fabrication for producing a CCL, wherein the resistor device is completed and embedded in the PCB when fabrication of PCB is completed. Thus, the fabrication advantages when compared to the conventional method of individually fabricating the copper foil wiring and passive component are apparent.

According to the embodiments, the composite resistor film 107 comprising a copper oxide layer formed by oxidizing a copper foil and a plurality of dispersed metal islands formed by a solution containing metal can have high sheet resistance and low TCR. Thus, allowing the resistor film 107 of the embodiments of the invention, meet the major resistance ranges of current applications. Moreover, since the resistor film 107 can be fabricated by low temperature in non-vacuum environment, fabrication costs can be reduced and polymer substrate compatibility can be increased.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A thin film resistor structure, comprising:

a resistor film, comprising:

a copper oxide layer having a top surface comprising a plurality of adjacent nodule-shaped recess regions, wherein vacancies are formed between the nodule-shaped recess regions and are arranged in reticulate distribution; and a plurality of metal islands on the copper oxide layer and is respectively distributed in the vacancies between the nodule-shaped recess regions.

2. The resistor structure of claim 1, further comprising:

an insulating substrate disposed under the resistor film; and an insulating layer partially covering the resistor film to expose both ends of thereof; and two electrodes respectively covering the exposed ends of the resistor film and electrically connected thereto.

3. The resistor structure of claim 2, wherein the insulating layer comprises solder mask.

4. The resistor structure of claim 2, wherein each electrode comprises copper foil.

5. The resistor structure of claim 2, wherein the insulating substrate comprises epoxy or polyimide (PI).

6. The resistor structure of claim 1, wherein the copper oxide layer comprises nickel oxide therein.

7. The resistor structure of claim 1, wherein the plurality of metal islands comprises platinum (Pt), palladium (Pd), Ruthenium (Ru), Rhodium (Rh), Iridium (Ir), Aurum (Au), Argent (Ag), or alloy thereof.

8. The resistor structure of claim 1, wherein the plurality of metal islands comprises palladium, and copper content in the resistor film of more than 15.0 $\mu g/cm^2$ and palladium content in the resistor film of more than 7.0 $\mu g/cm^2$.

9. A method for fabricating a thin film resistor structure, comprising:

providing a copper foil substrate having a top surface comprising a plurality of adjacent nodule-shaped protrusions, wherein vacancies are formed between the nodule-shaped protrusions and are arranged in reticulate distribution;

coating a solution containing metal on the top surface of the copper foil substrate and filling the vacancies between the nodule-shaped protrusions;

performing a heat treatment process on the copper foil substrate to form a copper oxide layer on the surfaces of the nodule-shaped protrusions and simultaneously form a plurality of metal islands, transformed from the solution containing metal, in the vacancies between the nodule-shaped protrusions;

placing the copper foil substrate against an insulating substrate, such that the copper oxide layer is bonded with the insulating substrate;

defining a resistor region and two electrode regions on the copper foil substrate;

partially exposing the copper oxide layer and the plurality of metal islands by removing the copper foil substrate and the nodule-shaped protrusions corresponding to the resistor region, such that the exposed copper oxide layer has a top surface comprising a plurality of nodule-shaped recess regions; and covering the exposed copper oxide layer and filling the plurality of nodule-shaped recess regions with an insulating layer.

10. The method of claim 9, wherein the insulating layer comprises solder mask.

11. The method of claim 9, wherein the insulating substrate comprises epoxy or polyimide (PI).

12. The method of claim 9, wherein the copper oxide layer comprises nickel oxide therein.

13. The method of claim 9, wherein the plurality of metal islands comprises platinum (Pt), palladium (Pd), Ruthenium (Ru), Rhodium (Rh), Iridium (Ir), Aurum (Au), Argent (Ag), or alloy thereof.

14. The method of claim 9, wherein the plurality of metal islands comprises palladium, and copper content in the resistor film of more than 15.0 $\mu g/cm^2$ and palladium content in the resistor film of more than 7.0 $\mu g/cm^2$.

15. The method of claim 9, wherein the solution containing metal is a solution comprising a mixture of $Pd(OAc)_2$ and $CHCl_3$.

16. The method of claim 15, wherein the solution comprising the mixture of $Pd(OAc)_2$ and $CHCl_3$ has a concentration of about 0.1 g/10 cc to 0.4 g/10 cc.

17. The method of claim 9, wherein the solution containing metal is a colloidal solution containing metal particles.

18. The method of claim 9, wherein the solution containing metal is coated on the top surface of the copper foil substrate by a dip coating, spin coating, spray coating, or slot die coating process.

19. The method of claim 9, wherein the heat treatment is performed in a non-vacuum environment at a temperature lower than 300° C.

* * * * *